US005580044A

United States Patent [19]

Wafler

[11] Patent Number: 5,580,044

[45] Date of Patent: Dec. 3, 1996

[54] LOW ASPECT RATIO, WIDE BELT/LONG ROLLER TRACKING SYSTEM

[75] Inventor: Walter F. Wafler, Rochester, N.Y.

[73] Assignee: Xerox Corporation, Stamford, Conn.

[21] Appl. No.: 357,808

[22] Filed: Dec. 16, 1994

[51] Int. Cl.[6] ..... B65H 5/02

[52] U.S. Cl. ..... 271/275; 198/840; 198/842; 271/198

[58] Field of Search ..... 271/188, 198, 271/275; 198/806, 842, 840; 193/37

[56] References Cited

U.S. PATENT DOCUMENTS

| | | | |
|---|---|---|---|
| 1,969,073 | 8/1934 | Hamre . | |
| 4,367,031 | 1/1983 | Hamaker | 355/3 BE |
| 4,397,538 | 8/1983 | Castelli et al. | 355/3 BE |
| 4,505,695 | 3/1985 | Billings | 493/459 |
| 4,917,232 | 4/1990 | Densmore | 198/830 |
| 5,070,365 | 12/1991 | Agarwal | 355/212 |
| 5,201,514 | 4/1993 | Rebres | 271/188 |
| 5,202,737 | 4/1993 | Hollar | 355/308 |
| 5,213,202 | 5/1993 | Arnold | 198/842 |
| 5,287,157 | 2/1994 | Miyazato et al. | 355/309 |
| 5,316,524 | 5/1994 | Wong et al. | 474/151 |
| 5,365,321 | 11/1994 | Koshimizu et al. | 198/806 X |

FOREIGN PATENT DOCUMENTS

| | | | |
|---|---|---|---|
| 4-148744 | 5/1992 | Japan | 271/198 |

*Primary Examiner*—F. J. Bartuska

[57] ABSTRACT

A device for tracking a belt moving along a path in a predetermined direction, including a member including opposed arcuate marginal regions and a central region interposed therebetween. The opposed arcuate marginal regions have a first coeffecient of friction and the central region has a second coeffecient of friction less than the first coeffecient of friction so as to maintain the belt moving over the member in substantial alignment with the predetermined direction. A second belt path defining member or roller may further contribute to straight belt tracking. Plural belt/roller systems may be used cooperatively in sheet moving systems and decurlers in printing machines and in other applications.

18 Claims, 7 Drawing Sheets

LOW ASPECT RATIO, WIDE BELT/LONG ROLLER TRACKING SYSTEM

The present invention relates to sheet movement through an electronic reprographic image forming apparatus using belts and rollers, and more particularly to a belt and roller tracking system for use in sheet moving applications such as in post toner fusing sheet decurlers.

In electrophotographic applications such as xerography, a charge retentive photoreceptor belt is electrostatically charged according to the image to be produced. In a digital printer, an input device such as a raster output scanner controlled by an electronic subsystem can be adapted to receive signals from a computer and to transpose these signals into suitable signals so as to record an electrostatic latent image corresponding to the document to be reproduced on the photoreceptor. In a digital copier, an input device such as a raster input scanner controlled by an electronic subsystem can be adapted to record an electrostatic latent image on the photoreceptor. In a light lens copier, the photoreceptor may be exposed to a pattern of light or obtained from the original image to be reproduced. In each case, the resulting pattern of charged and discharged areas on photoreceptor form an electrostatic charge pattern (an electrostatic latent image) conforming to the original image.

The electrostatic image on the photoreceptor may be developed by contact with a finely divided electrostatically attractable toner. The toner is held in position on the photoreceptor image areas by the electrostatic charge on the surface. Thus, a toner image is produced in conformity with a light image of the original being reproduced. Once each toner image is transferred to a sheet, the image is affixed thereto so as to form a permanent record of the image to be reproduced. Sheet movement throughout the printer may be accomplished using a variety of belts and rollers. These belts and rollers move the sheet along the sheet path, from the input tray to the output tray, along stations such as sorting, stacking, collating, compiling, stapling and/or other sheet handling systems. After a toned image is fused to the sheet, particularly when duplex or multiple layer/color printing, mild to severe sheet curling can occur. Single or multiple layers of toner may be applied to a substrate in creating the simplex, duplex or multicolor copy or print. Specialized belt and roller applications, such as post-fusing decurlers, can present particular sheet moving and belt/roller tracking problems. Depending on the nature of the sheets being transported (such as plain paper, cover stock, synthetic/plastic materials) the task of transporting a sheet through a close roller, wide belt decurler can be difficult to manage.

Various approaches have been employed to move sheets through a sheet path using rollers and belts, including the following disclosures which may be relevant:

U.S. Pat. No. 5,316,524

Patentee: Wong et al

Issued: May 31, 1994

U.S. Pat. No. 5,287, 157

Patentee: Miyazato

Issued: Feb. 15, 1994

U.S. Pat. No. 5,202,737

Patentee: Hollar

Issued: Apr. 13, 1993

U.S. Pat. No. 5,201,514

Patentee: Rebres

Issued: Apr. 13, 1993

U.S. Pat. No. 5,070,365

Patentee: Agarwal

Issued Dec. 3, 1991

U.S. Pat. No. 4,917,232

Patentee: Densmore

Issued: Apr. 17, 1990

U.S. Pat. No. 4,505,695

Patentee: Billings

Issued: Mar. 19, 1985

U.S. Pat. No. 4,397,538

Patentee: Castelli et al

Issued: Aug. 9, 1983

U.S. Pat. No. 4,367,031

Patentee: Hamaker

Issued: Jan. 4, 1993

U.S. Pat. No. 1,969,073

Patentee: Hamre

Issued: Aug. 7, 1934

The pertinent portions of the foregoing disclosures may be briefly summarized as follows:

U.S. Pat. No. 5,316,524 discloses a set of rolls arranged to support a belt passing thereover, such as in a four roller/belt photoreceptor system. The first roll has first and second ends; a first centering assembly for the belt is located adjacent the first roll. The first centering assembly includes a first rotating member located adjacent a first end of the first roll and a second rotating member located adjacent a second end of the first roll. The first and second rotating members urge the belt to an equilibrium position on the first roll. In one embodiment, the first and second rotating members are rollers which may either be tapered or crowned. A crowned roller/belt system in which three roller sections are biased apart by springs separating them is further disclosed.

U.S. Pat. No. 5,284,157 discloses a decurler including a depressing roll pushed against a belt positionable to contact a sheet passing therebetween. The decurler further includes a mechanism for adjusting the position of the depressing roll.

U.S. Pat. No. 5,202,737 discloses a decurler having a rod for deflecting a belt to define a nip therebetween. The belt is entrained about a pair of spaced rollers. A pair of baffle plates are located at the entrance to the nip and at the exit to the nip. The rod is adapted to move in a vertical direction so as to vary the degree of deflection and the bend of the sheet. The baffle plates at both the exit and entrance regions to the nip pivot in unison with the translation of the pivot rod so as to adjust the orientation of the sheet entering and leaving the nip.

U.S. Pat. No. 5,201,514 discloses a decurler including a decurler shaft and a first belt positionable to contact an arcuate portion of the decurler shaft; a second belt is also included, and is positionable to contact the first belt and to bend around the arcuate portion of the decurler shaft. The decurler further includes a mechanism for advancing the sheet between the first belt and the second belt so as to bend the sheet around the arcuate portion of the decurler shaft.

U.S. Pat. No. 5,070,365 discloses an apparatus in which lateral movement of a moving belt, such as a photoreceptor, is controlled in a three roller system so that the belt moves in a predetermined path. The apparatus includes dual oppositely wound, helical springs having a rectangular cross-section with a high friction material extruded thereon. The springs are mounted on a shaft with an adhesive.

U.S. Pat. No. 4,917,232 discloses flanged rollers which engage the lateral sides of the upper and lower runs of a flexible belt conveyor which traverses a curved path, so as to control lateral belt movement relative to the path of travel.

U.S. Pat. No. 4,505,695 discloses a mechanism for decurling copy sheets exiting the fuser apparatus of a copier having a compliant belt of pliable material, a curling roller forming a penetration nip with the compliant belt, the penetration nip being adapted to curl sheets to such an among as to over curl a sheet leaving the fuser apparatus. A decision gate is arranged and shaped to direct the sheet into one of two paths depending upon the degree of over curl. In one path, when slight curl is experienced, a curling device is arranged to compensate for the slight curl. In the other path, when a high degree of curl is present, a curling device is positioned to effect a high degree of reverse curl.

U.S. Pat. No. 4,397,538 discloses an apparatus which controls lateral alignment of a belt arranged to move along a predetermined path. A pivoted roller supports the belt; a flanged member is slidably mounted on a shaft extending outwardly from one end of the roller. A spring contacts the flanged member and resiliently urges one of the flanges into continuous engagement with one side of the belt. Movement of the belt slides the flanged member so that one of the flanges frictionally rotates a disc interposed therebetween. Rotation of the disc tilts the roller, thus restoring the belt to the desired path of movement.

U.S. Pat. No. 4,367,031 discloses an apparatus which maintains a moving belt in lateral alignment. The belt is supported so as to form an arcuate region therein. A guide engages the side edge of the belt in the arcuate region to prevent undesired lateral belt movement.

U.S. Pat. No. 1,969,073 discloses a sheet decurler for straightening sheets that are creased or rolled in handling. The sheet moves through a set of conveyor belts/rollers to flatten the sheet.

In accordance with one aspect of the present invention, there is provided an apparatus for tracking a belt moving along a path in a predetermined direction. The apparatus includes a member having opposed arcuate marginal regions and a central region interposed therebetween. The opposed arcuate marginal regions have a first coeffecient of friction and the central region has a second coeffecient of friction less than the first coeffecient of friction so as to maintain the belt moving over the member in substantial alignment with the predetermined direction.

In accordance with another aspect of the present invention, there is provided a printing machine for printing indicia on sheets of the type including an apparatus for tracking a belt moving along a path in a predetermined direction. The apparatus includes a member having opposed arcuate marginal regions and a central region interposed therebetween. The opposed arcuate marginal regions have a first coeffecient of friction and the central region has a second coeffecient of friction less than the first coeffecient of friction so as to maintain the belt moving over the member in substantial alignment with the predetermined direction.

The invention will be described in detail with reference to the following drawings, in which like reference numerals are used to refer to like elements. The various aspects of the present invention will become apparent as the following description proceeds and upon reference to the drawings, in which.

Figure 1:
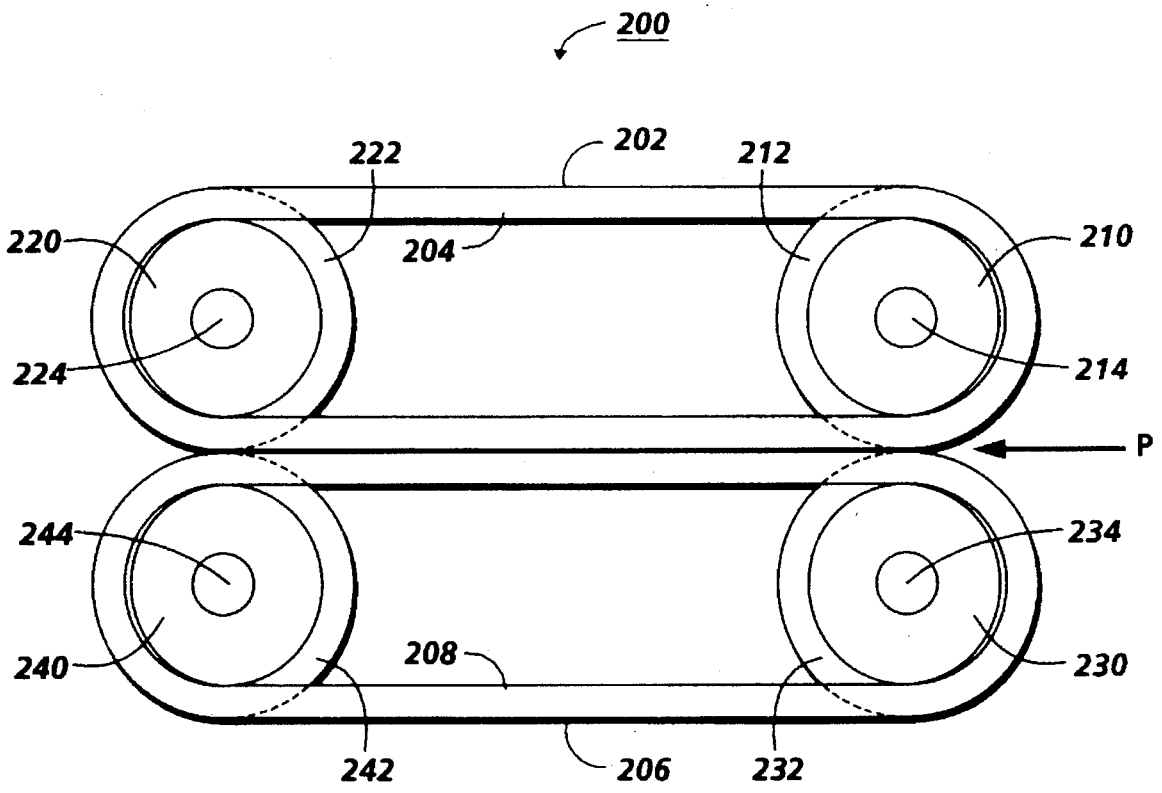
FIG. 1 is a schematic elevation view of an embodiment of the roller/belt tracking system of the present invention.

While the present invention will hereinafter be described in connection with preferred embodiments, it will be understood that it is not intended to limit the invention to a particular embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate like elements. It will become evident from the following discussion that the present invention and the various embodiments set forth herein are suited for use in a wide variety of printing, copying and other systems, and are not necessarily limited in application to the particular systems shown herein.

Figure 9:
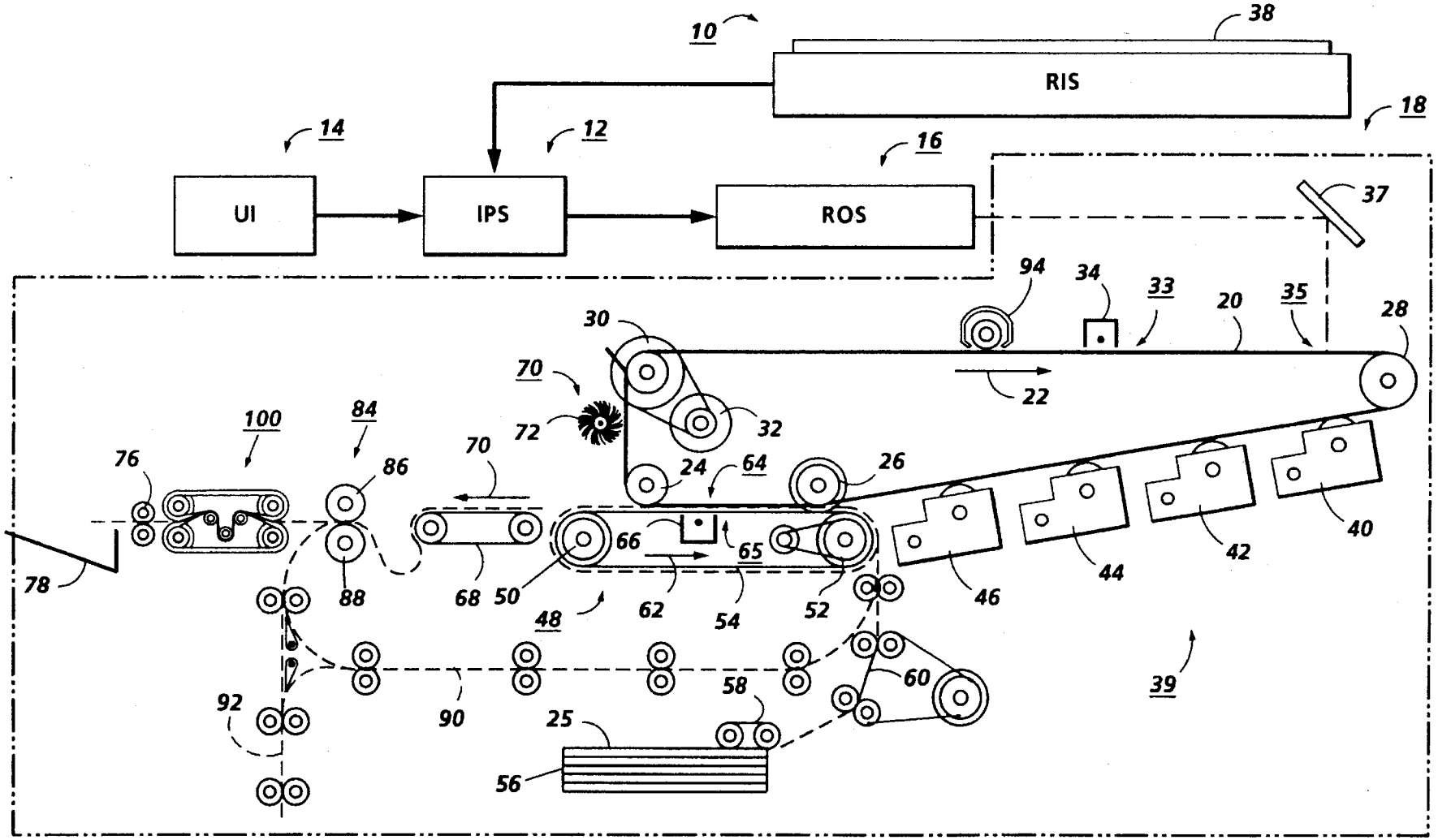
FIG. 9 is a schematic, elevational view showing an exemplary color electrophotographic printing machine which may incorporate the features of the present invention therein.

To begin by way of general explanation, FIG. 9 is a schematic elevational view showing an electrophotographic printing machine which may incorporate features of the present invention therein. It will become evident from the following discussion that the present invention is equally well suited for use in a wide variety of copying and printing systems, and is not necessarily limited in its application to the particular system shown herein. As shown in FIG. 9, during operation of the printing system, a multiple color original document 38 is positioned on a raster input scanner (RIS), indicated generally by the reference numeral 10. The RIS contains document illumination lamps, optics, a mechanical scanning drive, and a charge coupled device (CCD) array (not shown in FIG. 9). The RIS captures the entire image from original document 38 and converts it to a series of raster scan lines and moreover measures a set of primary color densities, i.e., red, green and blue densities, at each point of the original document. This information is transmitted as electrical signals to an image processing system (IPS), indicated generally by the reference numeral 12. IPS 12 converts the set of red, green and blue density signals to a set of colorimetric coordinates.

The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or marking engine, indicated generally by the reference numeral 18, at a rate of about 400 pixels per inch, to achieve a set of subtractive primary latent images. The ROS will expose the photoconductive belt to record three or four latent images which correspond to the signals transmitted from IPS 12. One latent image is developed with cyan developer material. Another latent image is developed with magenta developer material and the third latent image is developed with yellow developer material. A black latent image may be developed in lieu of or in addition to other (colored) latent images. These developed images are transferred to a copy sheet in superimposed registration with one another to form a multicolored image on the copy sheet. This multicolored image is then fused to the copy sheet forming a color copy.

With continued reference to FIG. 9, printer or marking engine 18 is an electrophotographic printing machine. Photoconductive belt 20 of marking engine 18 is preferably made from a photoconductive material. The photoconductive belt moves in the direction of arrow 22 to advance successive portions of the photoconductive surface sequentially through the various processing stations disposed about the path of movement thereof. Photoconductive belt 20 is entrained about rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having multicolored original document 38 positioned thereat. The modulated light beam impinges on the surface of photoconductive belt 20. The beam illuminates the charged portion of the photoconductive belt to form an electrostatic latent image. The photo-conductive belt is exposed three or four times to record three or four latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the complement of the specific color separated electrostatic latent image recorded on the photoconductive surface.

The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the nonoperative position, the magnetic brush is spaced therefrom. During development of each electrostatic latent image, only one developer unit is in the operative position, the remaining developer units are in the nonoperative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown in FIG. 9) extends between belts 54 and moves in unison therewith. A sheet 25 is advanced from a stack of sheets 56 disposed on a tray. A friction retard feeder 58 (which may include the roller and belt tracking system of the present invention as described in greater detail in association with FIGS through 5) advances the uppermost sheet from stack 56 onto a pretransfer transport 60. Transport 60 advances sheet 25 to sheet transport 48. Sheet 25 is advanced by transport 60 in synchronism with the movement of the sheet gripper. In this way, the leading edge of sheet 25 arrives at a preselected position, i.e., a loading zone, to be received by the open sheet gripper. The sheet gripper then closes securing sheet 25 thereto for movement therewith in a recirculating path. The leading edge of sheet 25 is releasably secured by the sheet gripper. As belts 54 move in the direction of arrow 62, the sheet moves into contact with the photoconductive belt, in synchronism with the toner image developed thereon. In transfer zone 64, a gas directing mechanism (not shown) may direct a flow of gas onto sheet 25 to urge the sheet toward the developed toner image on photoconductive member 20 so as to enhance contact between the sheet and the developed toner image in the transfer zone. Further, in transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three or four different color toner images are transferred to the sheet in superimposed registration with one another.

One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, onto the sheet to form the multicolored copy of the colored original document.

After the last transfer operation, the sheet transport system directs the sheet to a conveyor 68 (which may include the roller and belt tracking system of the present invention as described in greater detail in association with FIGS. 1 through 5). Conveyor 68, which may further include a vacuum-assisted tacking mechanism (not shown in FIG. 9) transports the sheet, in the direction of arrow 70, to a fusing station, indicated generally by the reference numeral 84, where the transferred toner image is permanently fused to the sheet. The fusing station includes heated fuser roll 86 and pressure roll 88. The sheet passes through the nip defined by rolls 86 and 88. After (or before) the fusing station, a recirculating document path 90 may return sheet 25 to a sheet side reversing device 92, and thereafter to sheet transport 48, for duplex printing on the other side of sheet 25, and thereafter for a second fusing of the second (duplex) toned image by fuser 84 (as described above).

After the fuser fixes the image to the sheet, decurler 100 (which may include the roller and belt tracking system of the present invention as described in greater detail in association with FIGS. 1 through 8) decurls the sheet. Variations of belt tracking assembly of the present invention as may be employed with the FIG. 9 exemplary color electrophotographic printing machine are further described below. Thereafter, the sheet is advanced by a pair of rolls 76 to a catch tray 78 (or sorter, not shown in FIG. 9) for subsequent removal therefrom by the machine operator.

The final processing station in the direction of movement of belt 20, as indicated by arrow 22, is a photoreceptor cleaning apparatus, indicated generally by the reference numeral 70. A rotatably mounted fibrous brush 72 may be positioned in the cleaning station and maintained in contact with photoconductive belt 20 to remove residual toner particles remaining after the transfer operation. Thereafter, lamp 94 illuminates photoconductive belt 20 to remove any residual charge remaining thereon prior to the start of the next successive cycle.

FIG. 1 shows belt 202 including curved edge portions 204, for mating with the curved roller end surfaces 212 and 222 of rollers 210 and 220, respectively. Rollers 210 and 220, rotate on axles 214 and 224, respectively. FIG. 1 further shows curved belt edge portions 208 of belt 206 mating with the curved roller 230 and 240 curved end portions 232 and 242, respectively. Rollers 230 and 240, rotate on axles 234 and 244, respectively. A sheet (not shown in FIG. 1) may pass in direction P between the outer surfaces of belts 202 and 206 in system 200.

Wide belts entrained about closely spaced rollers (which may also be described as having a low "aspect" or length-to-width ratio) have typically proven to be very difficult to track. Known systems and methods may use a relatively uniformly curved or "crowned" roller to track belts. This system works by lateral differential straining of the belt, causing the belt to track to the center of the roller. The strain in the plane of the belt in such systems is less at the center of the belt; as such, the belt tends to run at the minimum strain energy. The problems with such constant surface crowned rollers include that that the differential forces on the belt may cause it to buckle, in addition to the difficulty and expense of producing such crowned rollers and stress resistant belts.

With continued reference to FIG. 1, the wide roller/belt system 200 of the present invention enables simple and effective tracking by a combination of curved belt edges 204 mated with curved end rollers surfaces 212 and 222; likewise, curved belt edges 208 are mated with curved end rollers surfaces 232 and 242. The mated characteristics of the curved edge belts and curved end rollers allow the required track correcting forces to effectively overcome the axial misalignment (lateral) forces that may act on the belts. In some systems (such as sheet decurlers), this system works most effectively when a highly elastomeric material is used to in the belts.

Figure 2:
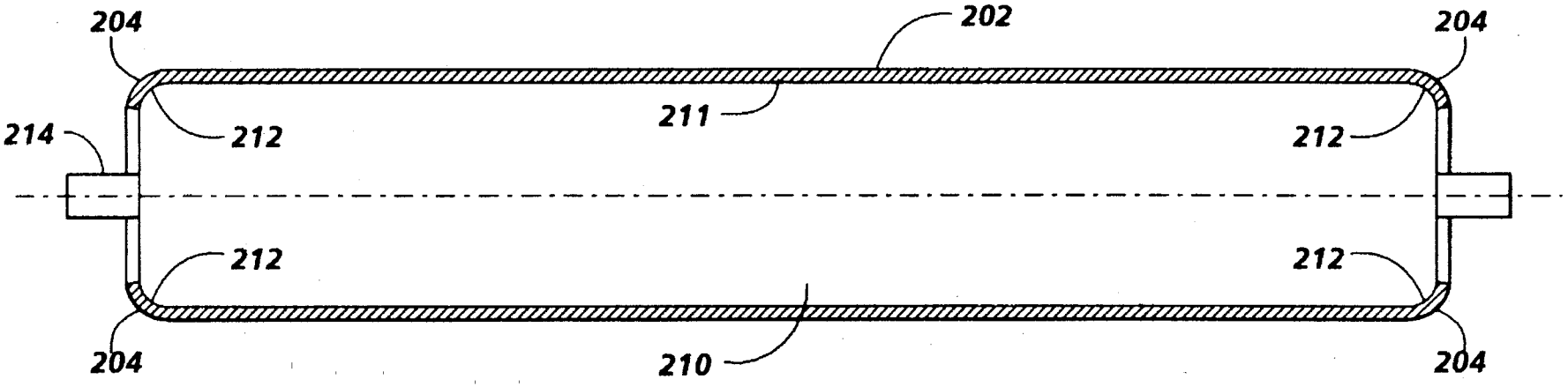
FIG. 2 is a cross-sectional view of a roller and belt according to the system shown in FIG. 1.

FIG. 2 shows a cross sectional view of roller 210 and belt 202 of FIG. 1. (Rollers 210, 220, 230 and 240 as shown in FIG. 1 may be formed in the same manner, as may belt 206.) The center surface circumference area of roller 210 includes a flat roller surface 211. The end surface areas of roller 210 include curved portions 212. Roller 210 turns on axis 214, as shown in FIG. 1. Belt 202 includes a center flat region mating with the center flat surface area of roller 210. The edges of belt 204 include curved regions 204, mating with a curved roller end surface areas 212 of roller 210. In a preferred embodiment, the constant diameter center section of roller 210, flat surface 211, covers approximately 90% of the belt width with a smooth, low friction surface area. The curved roller end surface areas 212 of roller 210 provide the corrective tracking force on edges 204 of belt 202. During misalignment, an outermost portion of a belt edge 204 contacts a curved roller 210 end surface area 212 with increasing force once belt to roller misalignment occurs. These forces on one or the other of the outermost portions of edges 204 contact curved roller end surface areas 212 (depending on the lateral direction of the misalignment) continue until they force the belt 202 back into (centered) realignment on roller 210. At the same time, the smooth wide cylindrical flat roller surface 211 of roller 210 and the smooth inner surface of belt 202 allow belt 202 to track sideways during this realignment process without buckling. In addition to other advantages, the curved end rollers of the present invention can be simpler and less expensive to manufacture, as only the ends of the rolls are nonuniformly machined or formed, in contrast to known continuously crowned rolls. The curved end/edge characteristics of the rollers and belts of the present invention allow the track correcting forces to effectively overcome axial misalignment forces until belt equilibrium is reestablished. As such, the wide roller/short belt system of the present invention shown in FIG. 2 thus enables simple and effective tracking by a combination of smooth belt edges coupled with smooth curved end rollers.

Figure 3:
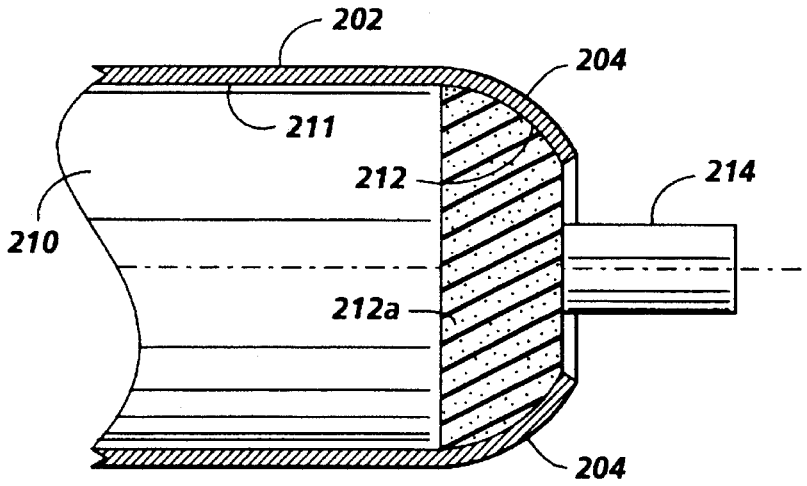
FIG. 3 is a partial, cross sectional view of another embodiment of a belt and roller of the present invention.

FIG. 3 shows another embodiment of roller 210, including a flat surface area 211 and curved end portions 212. A curved end portion surface area 212 of roller 210 includes a frictional coated (such as rubber or an elastomeric synthetic material) region 212*a*, for frictionally engaging curved belt edge areas 204 of belt 202. Roller 210 turns on axis 214 (as shown in FIG. 1). Belt 202 includes a center flat region mating with the center flat surface area 211 of roller 210. The edges of belt 204 include curved regions 204, mating with a curved roller end surface areas 212 of roller 210. The constant diameter center section of flat roller surface 211 is a smooth, low friction surface. The curved roller end surface areas 212 of roller 210 provides the corrective tracking force on edges 204 of belt 202, while the smooth wide cylindrical flat roller surface 211 of roller 210 allows the belt to track sideways without buckling. The curved ends roll of the present invention is very simple to make and less expensive to manufacture, as only the ends of the rolls are nonuniformly machined or formed, in contrast to known continuously crowned rolls. The wide roller/belt system shown in FIG. 2 of the present invention thus enables simple and effective tracking by a combination of smooth belt edges coupled with smooth curved end rollers. The friction characteristics of frictional coated region 212*a* of roller 210 increase the belt track correcting forces (over those resulting from smooth curved roller ends) once the belt begins to migrate to an off center position, thus overcoming the axial misalignment forces.

Figure 4:
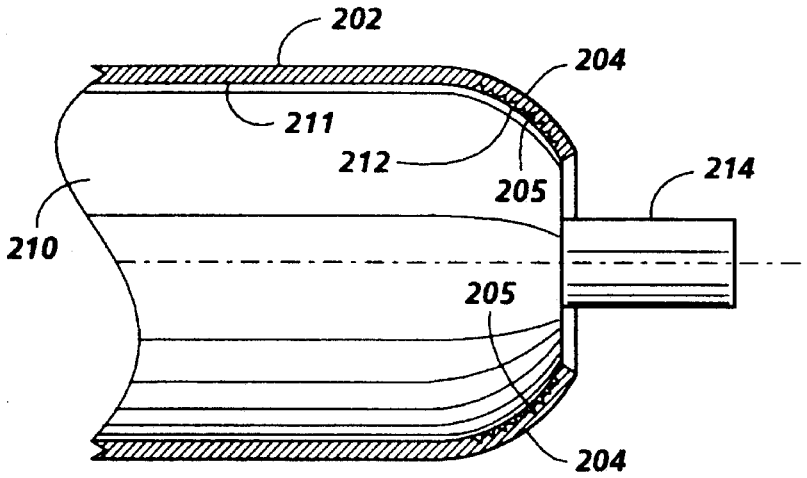
FIG. 4 is a partial, cross sectional view of another embodiment of a belt and roller of the present invention.

FIG. 4 shows another embodiment of roller 210, which includes flat surface areas 211 and curved end areas 212. Belt 202 includes a flat central portions mating with a flat surface area 211 of roller 210, and curved end portions 204 mating with curved roller end surface areas 212. The curved end portions 204 of belt 202 further include a high friction inner surface belt edge areas 205 for contacting roller 210 curved end surface areas 212. Roller 210 turns on axis 214 (as shown in FIG. 1). The constant diameter section of flat roller surface 211 covers the majority of the belt width contact area with a very smooth, low friction surface. The curved roller end surface areas 212 of roller 210 provides the corrective tracking force on edges 204 of belt 202, while the smooth wide cylindrical flat roller surface 211 of roller 210 allows the belt to track sideways without buckling. The wide roller/belt system shown in FIG. 2 of the present invention thus enables simple and effective tracking by a combination of textured or coated high friction inner surface belt edges coupled with smooth curved end rollers. High friction inner surface belt edge areas 205 of belt edges 204 frictionally engage curved roller end surface areas 212, increasing the belt track correcting forces (over those resulting from smooth curved roller ends) once the belt begins to migrate to an off center position.

Figure 5:
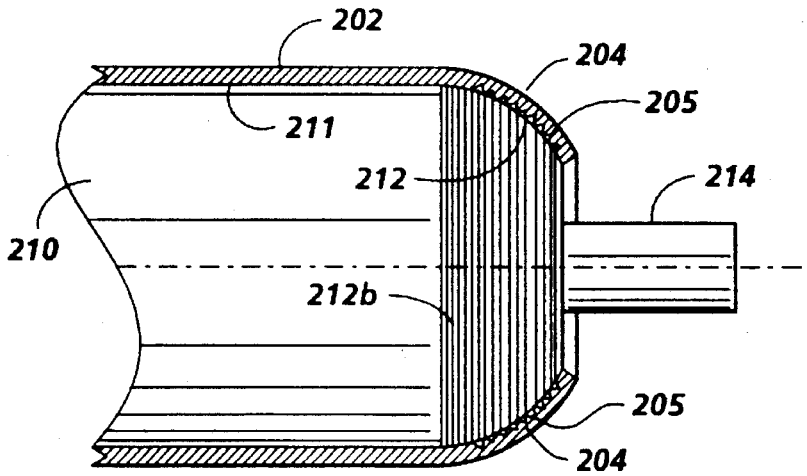
FIG. 5 is a partial, cross sectional view of another embodiment of a belt and roller of the present invention.

FIG. 5 shows another embodiment of roller 210, which includes flat surface areas 211 and curved end areas 212. Belt 202 includes a flat central portions mating with a flat surface area 211 of roller 210, and curved end portions 204 mating with curved roller end surface areas 212. Roller 210 turns on axis 214, as shown in FIG. 1. Curved end portion surface area 212 of roller 210 includes a set of concentric scoring rings 212*b*, for frictionally engaging curved belt edge areas 204 of belt 202. The curved end portions 204 of belt 202 include a high friction inner surface belt edge areas 205 for contacting roller 210 the set of concentric scoring rings 212*b* on curved end portion surface area 212. As in other embodiments, the constant diameter section of flat roller surface 211 covers the majority of the belt width contact area with a very smooth, low friction surface. The concentric scoring rings 212*b* of roller 210 provides greater corrective tracking force on high friction inner surface belt edge areas 205 of belt edges 204 than embodiments having smooth belt edges and roller ends, or than embodiments having either frictionalized belt edges or frictionalized roller ends. The smooth wide cylindrical fiat roller surface 211 of roller 210 allows the belt to track sideways as required without buckling. The wide roller/belt system shown in FIG. 5 of the present invention thus enables simple and effective tracking by a combination of textured or coated high friction belt edges coupled with smooth curved end rollers. High friction surface areas 205 of curved belt edge areas 204 frictionally engage concentric scoring rings 212*b* of curved roller 210 end surface areas 212, thus increasing the belt track correcting forces once the belt begins to migrate to an off center position.

Figure 6:
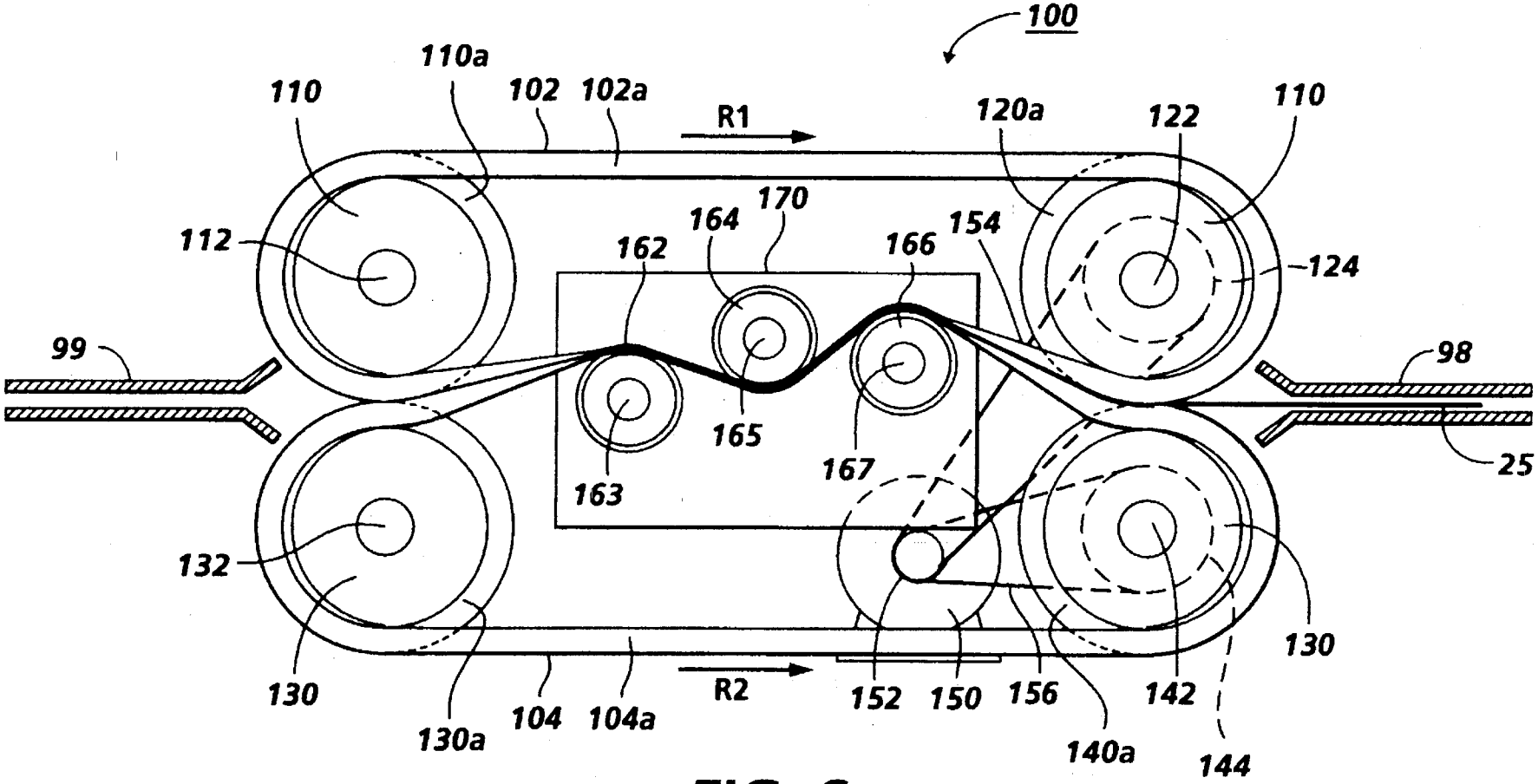
FIG. 6 is an elevational view of one embodiment of the roller and belt tracking assembly of the present invention in use in a sheet decurler.

FIG. 6 shows a roller/belt tracking system of the present invention in a decurler 100 employing a first set of roller 110 opposed by roller 130 and a second set of roller 120 opposed by roller 140. Rollers 110, 120, 130 and 140 include, respectively, curved ends 110*a*, 120*a*, 130*a* and 140*a* (such as may be formed according to roller 210 curved end areas 212 as described in conjunction with FIGS. 2 through 5 above). A sheet entry baffle 98 guides each sheet 25 into decurler 100; sheet 25 is decurled by following a path between belts 102 and 104. Belts 102 and 104 include, respectively, curved edges 102*a* and 104*a* (such as may be formed according to belt 202 edges 204 as described in conjunction with FIGS. 2 through 5 above). Sheet exit baffle 99 guides decurled sheets 25 out of decurler 100. Axle 112 holds roller 110, and is rotatably mounted on a bracket (not shown); axle 122 holds roller 120, and is likewise rotatably mounted on a bracket (not shown). A set of decurler members, rollers 162, 164 and 166 are rotatably mounted, respectively, on axles 163, 165 and 167; axles 163, 165 and 167 are fixed to mounting plate 170. Rollers 162, 164 and 166 rotate freely in response to movement of belt 102 threaded thereby as shown, so as to form the extended multidirectional decurling nip for decurling the sheet. Belt 102 is thus entrained about rollers 110, 120, 162, 164 and 166 as shown. Belt edges 102*a* and 104*a* are formed of an elastomeric material such that they flex to a flat position as shown in FIG. 6 when passing over rollers 163, 165 and 167. A motor 150 includes a drive pulley 152, for moving drive belt 154. A driven pulley 124 is mounted at one end of axle 122, such that drive belt 154 entrained about drive pulley 152 and driven pulley 124 drives roller 120; belt 102 is thus driven about rollers 110, 120, 166, 164and 162 in direction R1 as shown. Axle 132 holds roller 130, and is rotatably mounted on a bracket (not shown); axle 142 holds roller 140, and is likewise rotatably mounted on a bracket (not shown). Belt 104 is entrained as shown about rollers 130, 140, 162, 166 and 164 for decurling the sheet. A motor 150 includes a drive pulley 152, for moving drive belt 156. A driven pulley 144 is mounted at one end of axle 142, such that belt 156 entrained about drive pulley 152 and driven pulley 144 drives roller 140; belt 104 is thus driven about rollers 130, 140, 166, 164 and 162 in direction R2 as shown. In a preferred embodiment, the relative sheet wrap angle decreases as sheet 25 passes across roller 166, then 164, then 162. For example, the sheet (and belts 102 and 104) might wrap roller 166 for 80°, roller 164 for 50° and roller 162 for 30°. In this manner, sheet 25 may exit with minimum final curl, to include without curl induced by decurler 100.

Figure 7:
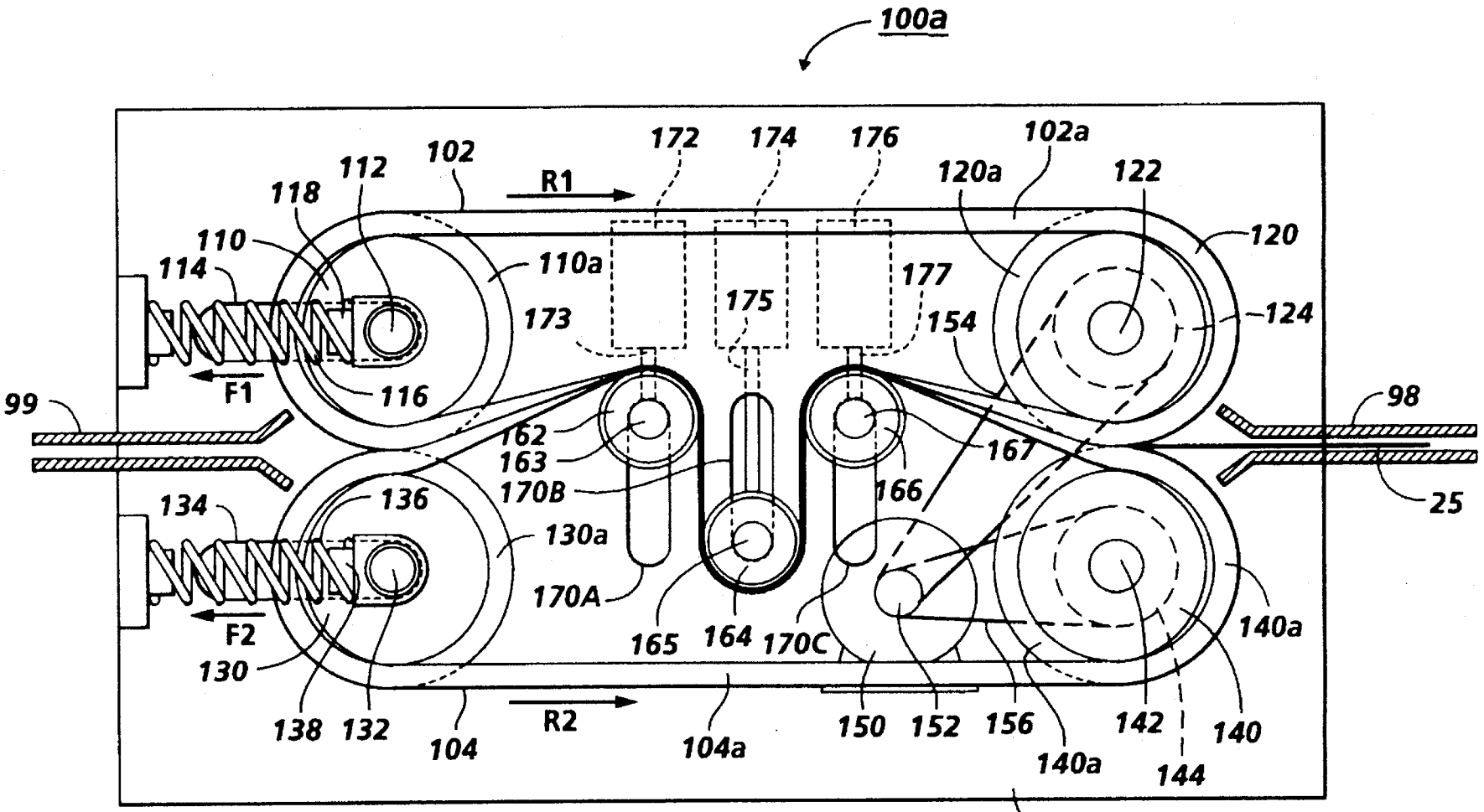
FIG. 7 is an elevation view of another embodiment of the roller and belt tracking assembly of the present invention in use in a sheet decurler.

FIG. 7 shows the roller/belt tracking system of the present invention in a decurler 100*a*. A sheet entry baffle 98 guides each sheet 25 into decurler 100*a*; sheet 25 is decurled by following a variable path between belts 102 and 104, as described in detail below. Sheet exit baffle 99 guides decurled sheets out of 25 decurler 100. FIG. 7 further shows a variable sheet decurling path and system that can handle virtually any sheet curl conditions, to include duplex and/or multilayer/color toned curled sheets.

With continued reference to FIG. 7, axle 112 holds roller 110, and is rotatably mounted in a slot 114 on a sliding tension bracket 118. In one embodiment, a spring 116 is positioned within slot 114, attached at one end of slot 114 and at the other end to a sliding tension bracket 118, so as to maintain the desired tension on belt 102 in direction F1 as shown. Belt edges 102*a* and 104*a* are formed of an elastomeric material such that they flex to a flat position as shown in FIG. 6 when passing over rollers 163, 165 and 167.

Axle 122 holds roller 120, and is likewise rotatably mounted on mounting bracket 103. A set of decurler members, rollers 162, 166 and 164 are rotatably mounted, respectively, on axles 163, 165 and 167. Axles 163, 165 and 167 slide, respectively, in slots 170*a*, 170*b* and 170*c* in mounting mounting bracket 103. Each solenoid 172 is connected by arm 173 to one end of axle 163, for variably positioning roller 162 in slot 170*a*. Each solenoid 174 is connected by arm 175 to one end of axle 165, for variably positioning roller 164 in slot 170*b*. Each solenoid 176 is connected by arm 177 to one end of axle 167, for variably positioning roller 166 in slot 170*c*. (In other embodiments, screw drives, and/or other electromechanical devices may be used to position rollers 162, 164 and/or 166 in slots 170A, 170B and 170C, respectively. Rollers 162, 166 and 164 rotate freely in response to movement of belt 102 threaded thereby as shown, so as to form the multilevel decurling path nips for decurling the sheet. Belt 102 is entrained about rollers 110, 120, 162, 166 and 164 as shown. Belts 102 and 104 include, respectively, curved edges 102*a* and 104*a* (such as may be formed according to belt 202 edges 204 as described in conjunction with FIGS. 2 through 5 above). Rollers 110, 120, 130 and 140 include, respectively, curved ends 110*a*, 120*a*, 130*a* and 140*a* (such as may be formed according to roller 210 curved end areas 212 as described in conjunction with FIGS. 2 through 5 above).

A motor 150 includes a drive pulley 152, for moving drive belt 154. A driven pulley 124 is mounted at one end of axle 122, such that belt 154 entrained about drive pulley 152 and driven pulley 124 drives roller 120; belt 102 is thus driven about rollers 110, 120, 162, 166 and 164 in direction R1 as shown. In one embodiment, a spring 136 is positioned within slot 134, attached at one end of slot 134 and at the other end to a sliding tension bracket 138, so as to maintain the desired tension on belt 104 in direction F2 as shown. Axle 132 holds roller 130, and is rotatably mounted on sliding tension bracket 138 in slot 134. Axle 142 holds roller 140, and is likewise rotatably mounted on bracket 103. Belt 104 is entrained as shown about rollers 130, 140, 162, 166 and 164 for decurling the sheet. A motor 150 includes a drive pulley 152, for moving drive belt 156. A driven pulley 144 is mounted at one end of axle 142, such that belt 156 entrained about drive pulley 152 and driven pulley 144 drives roller 140; belt 104 is thus driven about rollers 130, 140, 162, 166 and 164 in direction R2 as shown.

Figure 8:
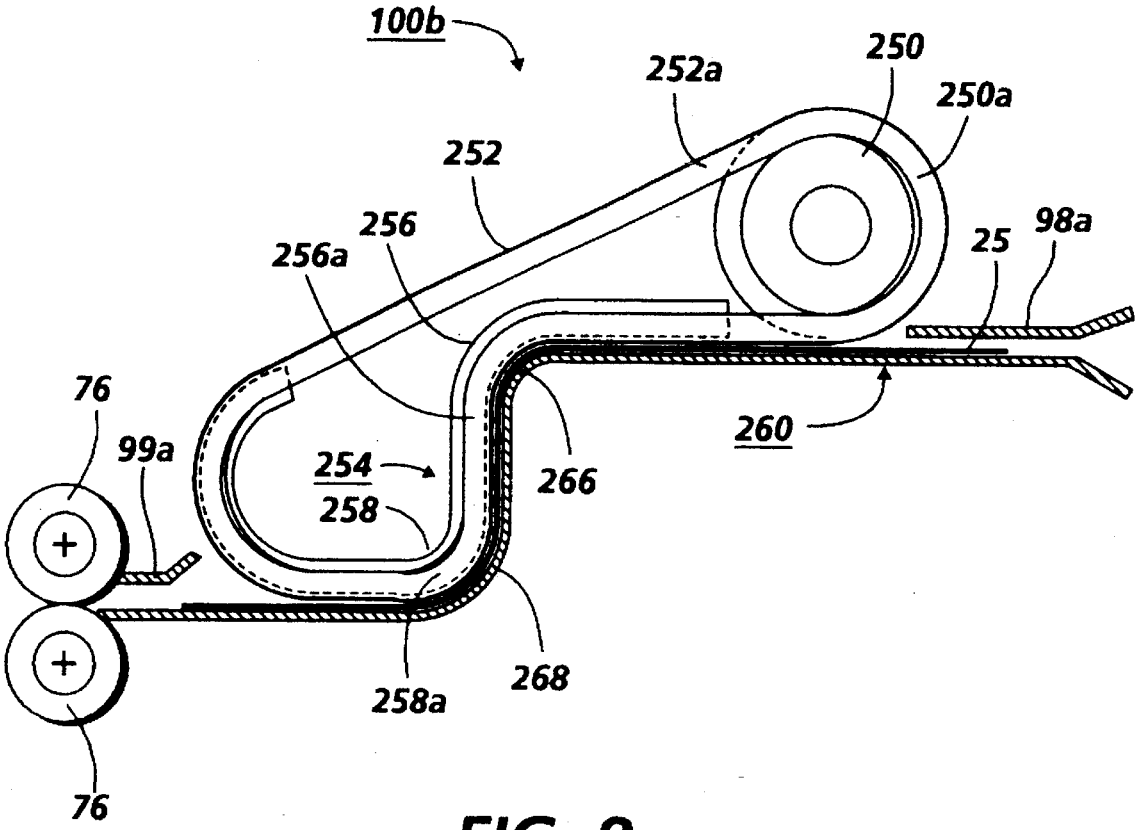
FIG. 8 is a schematic, elevation view of another embodiment of the belt and roller tracking assembly of the present invention in use in a sheet decurler.

FIG. 8 shows a schematic view of decurler roller and belt positioning of variable decurler 100*b* of the present invention. Decurler 100*b* includes a belt 252, a drive roller 250 and a path defining curved baffle 254 about which belt 252 is entrained. Roller 250 includes curved ends 250*a* (such as may be formed according to roller 210 curved end areas 212 as described in conjunction with FIGS. 2 through 5 above). Decurler 100*b* further includes belt 252 path defining curved baffle 260 for maintaining the required decurling nips opposite moving belt 252. Belt 252 includes curved edges 252*a* (such as may be formed according to belt 202 edges 204 as described in conjunction with FIGS. 2 through 5 above). Path defining curved baffles 254 and 260 include low friction surfaces for permitting the belt and/or sheet to pass with minimal drag. FIG. 8 shows a sheet 25 entry path under an entry baffle 98*a*. Sheet 25 is directed between belt 252 and baffle 260 for simplex or duplex decurling of upwardly and/or downwardly curled areas on sheet 25. Single drive/path defining roller 250 propels belt 252, which is backed by and slides across the low friction surface of baffle 254, and pulls sheet 25 through the decurling path. Belt 252 to sheet 25 traction is maintained as the sheet passes across decurling curves 256 and 258 of baffle 254, as well as across opposing curves 266 and 268 of baffle 260. Decurling curves 256 and 258 of baffle 254 are shown including curved belt 252 edge guide areas 256*a* and 258*a*, respectively. After sheet 25 has negotiated the decurling path, sheet 25 exits into sheet exit baffle 99*a* as shown, to be advanced by pair of rolls 76 to a catch tray or sorter (not shown). While other embodiments (FIGS. 1 through 7C) show a decurler which includes two belt transports having penetrating roller shafts, a single belt 252 and single drive roller 250 can guide a sheet through a set of baffles to provide the multiple bend wrap and flexing of the copy, to reduce or eliminate its curl.

Various embodiments of a the roller/belt tracking system have been described. While the present invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

I claim:

1. An apparatus for tracking a belt moving along a path in a predetermined direction, said apparatus comprising a member including opposed arcuate marginal regions and a central region interposed therebetween, said opposed arcuate marginal regions curving outwardly and downwardly away from said central region and having a first coefficient of friction, said central region having a second coefficient of friction less than the first coefficient of friction so as to maintain the belt moving over said central region and said arcuate marginal regions of said member in substantial alignment with the predetermined direction.

2. The apparatus of claim 1, wherein said belt comprises a flexibly elastomeric material.

3. The apparatus of claim 1, further comprising a baffle for guiding said belt.

4. The apparatus of claim 3, wherein said baffle comprises a first curved portion and a second curved portion with the first curved portion being from one of said arcuate marginal regions of said member and the second curved portion being from another of said arcuate marginal regions of said member.

5. The apparatus of claim 1, further comprising a second member, spaced from said first mentioned member for supporting the belt.

6. The apparatus of claim 5, wherein:

said first mentioned member comprises a rotatably mounted roller; and said second member includes a second rotatably mounted roller.

7. The apparatus of claim 6, further comprising:

a sheet guide adjacent to an external surface of the belt, said sheet guide forming a nip with the belt for moving a sheet therethrough.

8. The apparatus of claim 7, wherein the nip decurls a curl condition in the sheet passing therethrough.

9. The apparatus of claim 7, wherein said sheet guide comprises:

a third rotatable member;

a forth rotatable member; and second belt entrained about said third rotatable member and said forth rotatable member.

10. A printing machine of the type having an apparatus for tracking a belt moving along a path in a predetermined direction, said apparatus comprising a member including opposed arcuate marginal regions and a central region interposed therebetween, said opposed arcuate marginal regions curving outwardly and downward away from said central region and having a first coefficient of friction, said central region having a second coefficient of friction less than the first coefficient of friction so as to maintain the belt moving over said central region and said arcuate marginal regions of said member in substantial alignment with the predetermined direction.

11. The printing machine of claim 10, wherein said belt comprises a flexibly elastomeric material.

12. The printing machine of claim 10, further comprising a baffle for guiding said belt.

13. The printing machine of claim 12, wherein said baffle comprises a first curved portion and a second curved portion with the first curved portion being from one of said arcuate marginal regions of said member and the second curved portion being from another of said arcuate marginal regions of said member.

14. The printing machine of claim 10, further comprising a second member, spaced from said first mentioned member for supporting the belt.

15. The printing machine of claim 14, wherein:

said first mentioned member comprises a rotatably mounted roller; and said second member includes a second rotatably mounted roller.

16. The printing machine of claim 15, further comprising:

a sheet guide adjacent to an external surface of the belt, said sheet guide forming a nip with the belt for moving a sheet therethrough.

17. The printing machine of claim 16, wherein the nip decurls a curl condition in the sheet passing therethrough.

18. The printing machine of claim 16, wherein said sheet guide comprises:

a third rotatable member;

a forth rotatable member; and second belt entrained about said third rotatable member and said forth rotatable member.

* * * * *